United States Patent [19]

Potter

[11] 4,382,751

[45] May 10, 1983

[54] FUEL PUMPING APPARATUS

[75] Inventor: James C. Potter, London, England

[73] Assignee: Lucas Industries Limited, Birmingham, England

[21] Appl. No.: 232,189

[22] Filed: Feb. 6, 1981

[30] Foreign Application Priority Data

Feb. 14, 1980 [GB] United Kingdom ..... 8004955

[51] Int. Cl.[3] ..... F04B 19/00

[52] U.S. Cl. ..... 417/462; 417/252

[58] Field of Search ..... 417/462, 252, 253; 123/450; 137/47, 51, 82, 624.15

[56] References Cited

U.S. PATENT DOCUMENTS 4,292,012 9/1981 Botherston ..... 417/462

FOREIGN PATENT DOCUMENTS 1328211 4/1963 France ..... 137/47

*Primary Examiner*—Alan Cohan

[57] ABSTRACT

A fuel pumping apparatus includes a rotary distributor member mounting pumping plungers. The apparatus includes a chamber to which liquid can be supplied to vary an operating characteristic of the apparatus. A flow passage is provided through which liquid can flow to the chamber and a valve constituted by a port and grooves is provided so that liquid can be supplied to the space at specific times only during the rotation of the distributor member. An on/off valve is provided to control the flow of liquid through the flow passage.

2 Claims, 8 Drawing Figures

FUEL PUMPING APPARATUS

This invention relates to a fuel pumping apparatus of the kind comprising a body part, a rotary distributor member located in the body part and adapted to be driven in use, in timed relationship with the associated engine, a pumping plunger mounted in a transverse bore in the distributor member, a cam ring surrounding the distributor member and having angularly spaced cam lobes for imparting inward movement to the pumping plunger as the distributor member rotates, fluid pressure operable means for adjusting the setting of said cam ring whereby the timing of delivery of fuel can be varied, passage means for conveying fuel to and from the injection pump, a chamber defined in the apparatus to which liquid is admitted to vary an operating characteristic of the apparatus and means for varying the amount of liquid supplied to said chamber.

In a known form of the apparatus said chamber comprises a cylinder which houses a piston the setting of which is used to vary the angular setting of the cam ring. In another form of the apparatus the chamber is disposed at one end of the distributor member and the pressure in the chamber is used to control the axial setting of the distributor member whereby the amount of fuel which is delivered during the inward movement of the plungers can be varied. In both these cases it is desirable to be able to form a hydraulic lock at some time during the pumping cycle of the apparatus to avoid movement of the piston or the distributor member due to mechanical forces applied thereto. In another case the chamber constitutes the portion of the bore between the plungers.

The object of the present invention is to provide an apparatus of the kind specified in a simple and convenient form.

According to the invention an apparatus of the kind specified comprises a flow passage for conveying liquid to said chamber, a valve in said flow passage, said valve being operable to open and close said flow passage, said valve being operated upon rotation of the distributor member, means for determining when said valve is open and an on/off valve located in said flow passage and operable whilst the valve is open to permit flow of liquid through the flow passage.

Figure 1:
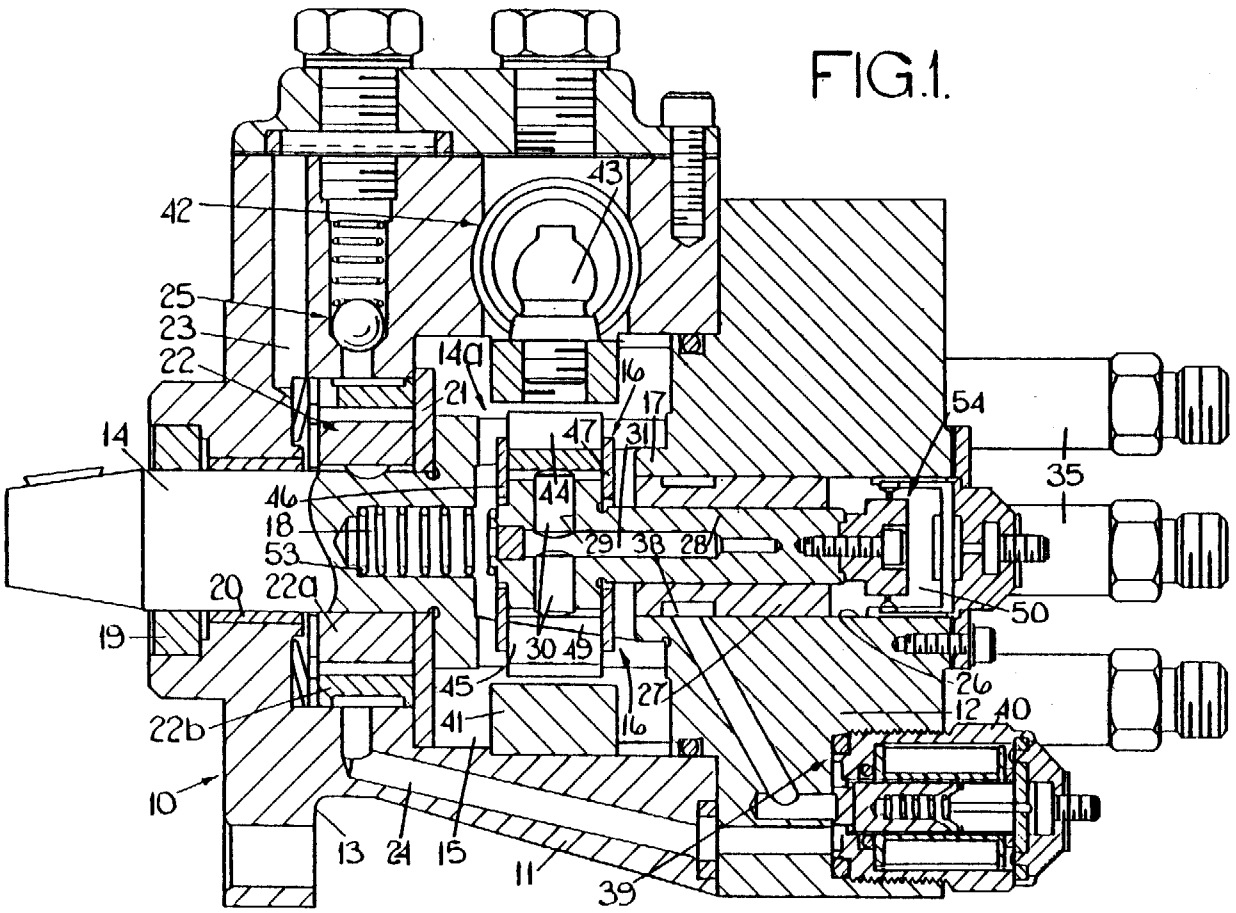
Figure 2:
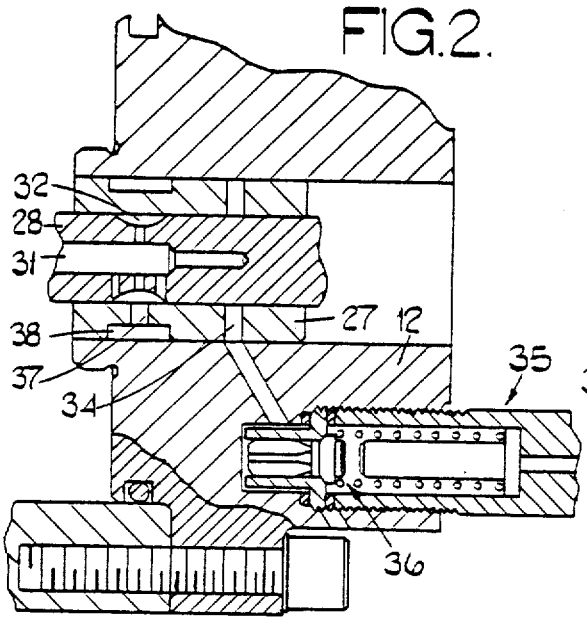
Figure 3:
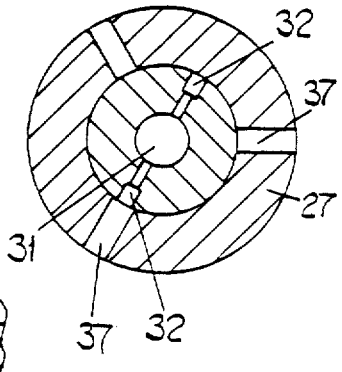
Figure 4:
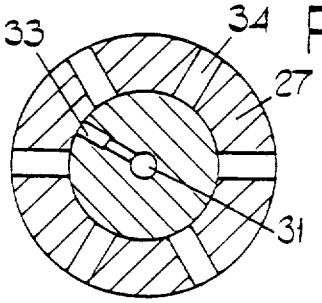
Figure 5:
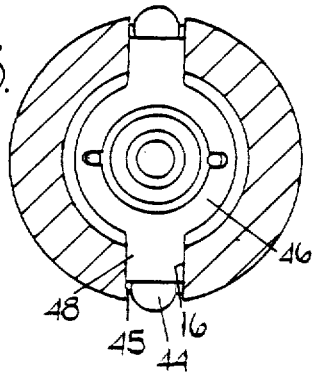
Figure 6:
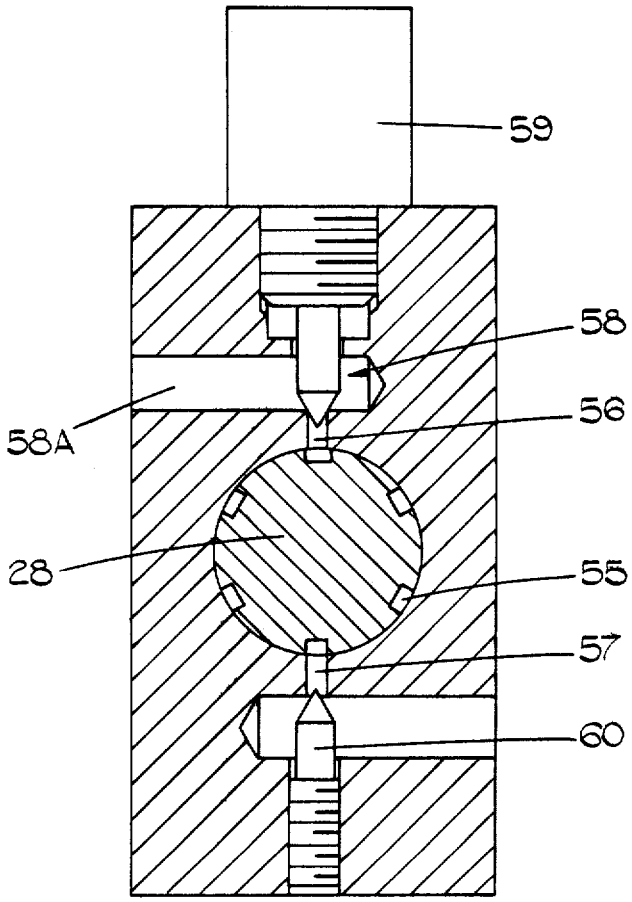
Figure 7:
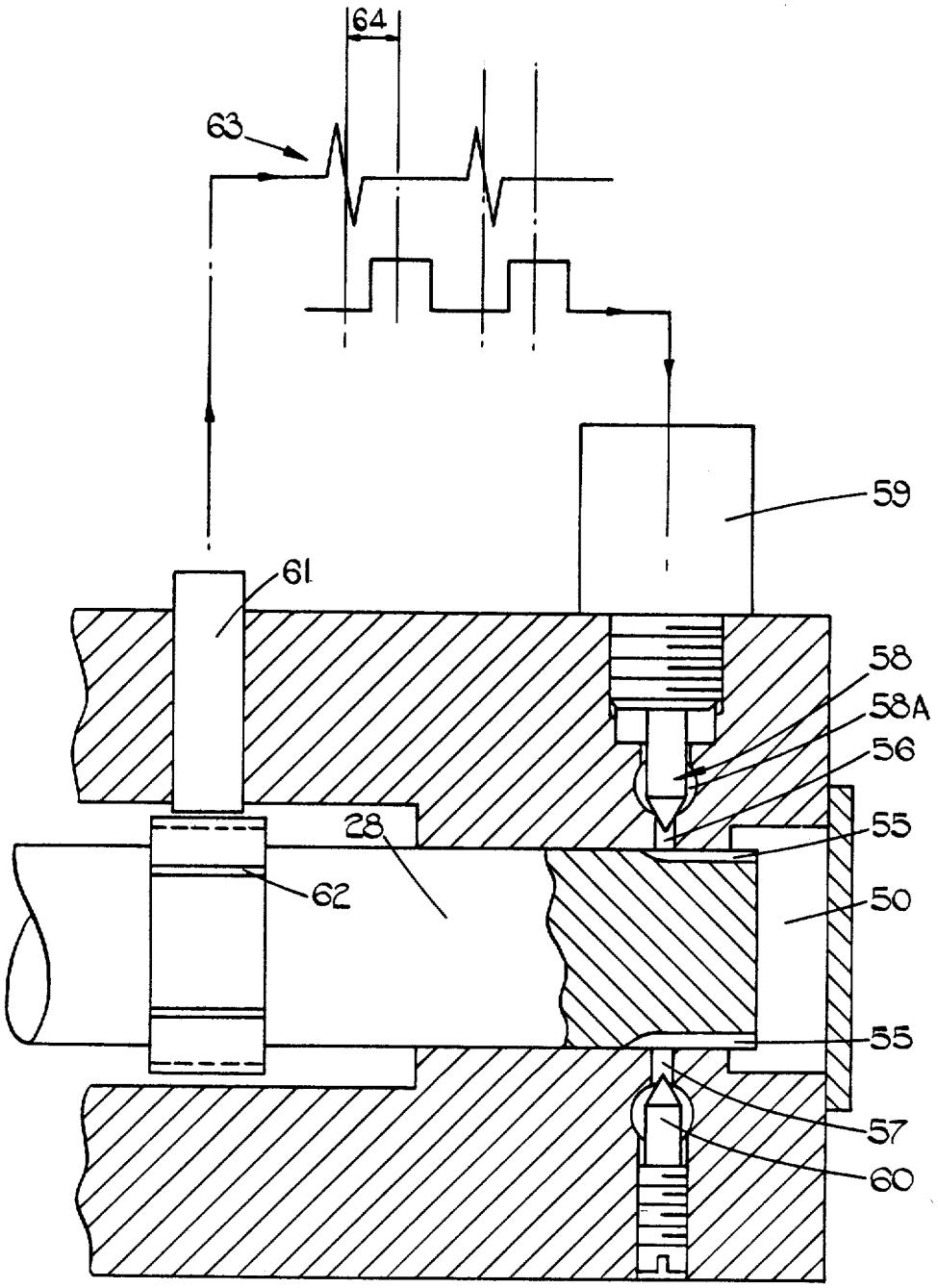

In the accompanying drawings:

FIG. 1 is a sectional side elevation of one example of an apparatus to which the invention may be applied, FIG. 2 is a section of a part of the apparatus seen in FIG. 1 taken along a different radial plane, FIGS. 3 and 4 are sections through parts of the apparatus seen in FIGS. 1 and 2, FIG. 5 is a section through part of the apparatus seen in FIG. 1, FIG. 6 is a section showing a part of the apparatus of FIG. 1 modified in accordance with the invention, and FIG. 7 shows a sectional side elevation of the part seen in FIG. 6.

Figure 8:
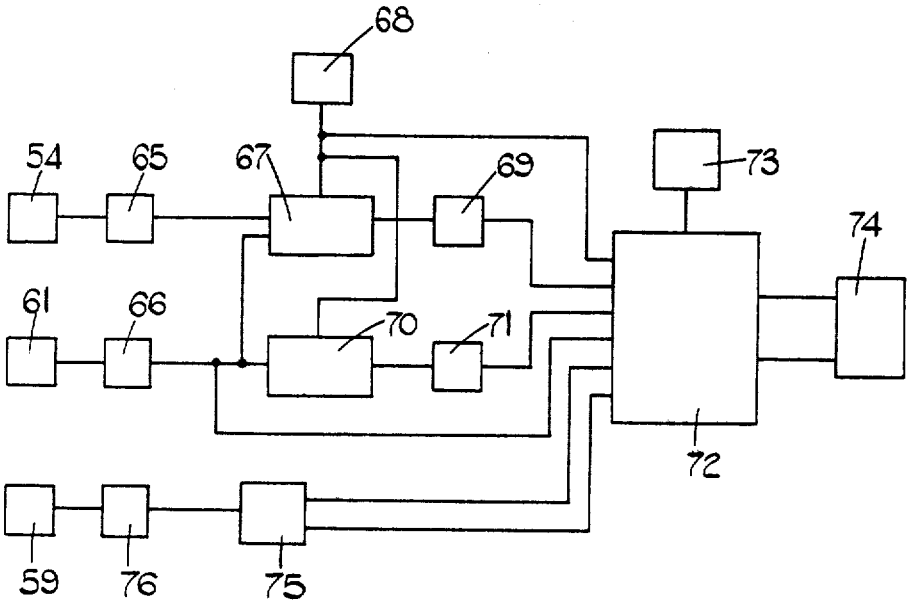

FIG. 8 shows a circuit for controlling a circuit for controlling the operation of a valve of the apparatus.

Referring to FIG. 1 of the drawings, the apparatus comprises a body part generally indicated at 10 and which conveniently is formed by a generally cup shaped portion 11 the open end of which is closed by a closure portion 12. The body portion 10 is provided with apertured lugs 13 whereby in use the apparatus can be secured to the engine with which it is associated.

The body portion 11 mounts a rotary drive shaft 14 which in use, is coupled to a drive member of the associated engine so that the drive shaft is rotated in synchronism with the engine. The drive shaft 14 extends into the generally cylindrical chamber 15 defined by the two body portions and has an enlarged cup shaped portion **14*a* within the chamber. The enlarged portion is provided with a pair of diametrically disposed slots 16. The enlarged portion of the drive shaft is hollow and at its end romote from the smaller diameter portion of the shaft the inner surface is of right cylindrical form and locates about a spigot portion 17 defined by the body portion 12. The remainder of the interior surface of the enlarged portion of the drive shaft tapers for a purpose which will be described. Moreover, the drive shaft is provided with a counter bore 18. An oil seal 19 is provided at the outer end of the body portion 10 for engagement with the drive shaft 14 and a sleeve bearing 20 supports the shaft for rotation, the shaft being given additional support by the spigot 17. The shaft is located against axial movement by thrust surfaces which engage with the end surfaces of the enlarged portion of the shaft. In one case the thrust surface is defined directly by the body portion 12 whilst in the other case, the thrust surface is defined by an annular plate 21 which surrounds the drive shaft and which additionally serves as an end closure for a low pressure fuel supply pump 22. The rotor 22*a* of the supply pump is carried by the drive shaft 14 and the rotor in turn carries vanes which co-operate with an eccentrically disposed surface on a stator ring 22*b* which is carried within a body portion 11. The low pressure pump has a fuel inlet 23 connected to a fuel inlet in a housing secured to the body portion 11 and a fuel outlet 24. Moreover, a relief valve 25** is provided to ensure that the output pressure of the pump remains within desired limits, the relief valve being connected between the inlet and the outlet.

Formed in the body portion 12 is a cylindrical bore 26 in which is fixed a sleeve 27. The sleeve 27 accommodates an angularly and axially movable distributor member 28 which projects into the chamber 15 and has an enlarged head portion lying within the chamber. Formed in the head portion of the distributor member is a transversely extending bore 29 in which is located a pair of pumping plungers 30. The bore 29 communicates with a blind passage 31 formed in the distributor member and which at its end within the head portion is sealed by means of a plug. As is more clearly shown in FIGS. 2, 3 and 4 the passage 31 communicates with a pair of diametrically disposed longitudinal slots 32 formed in the periphery of the distributor member and communicating with the passage 31 by means of a single or a plurality of connecting passages. The passage 31 also communicates with a further longitudinal slot 33 formed in the periphery of the distributor member and this slot communicates in turn with a plurality of outlet ports 34 formed in the sleeve 27 and as seen in FIG. 2, the outlet ports 34 communicate with outlets 35 respectively in the body portion 12. Each outlet incorporates a conventional form of delivery valve 36. The slots 32 register in turn with inlet ports 37 formed in the sleeve 27 and communicating with a circumferential groove 38 formed in the periphery of the sleeve. The groove 38 as shown in FIG. 1, communicates with the outlet 24 of the low pressure pump 22 by way of an on/off valve 39 conveniently controlled by an electromagnetic device 40. If desired a single slot 32 may be provided with the number of inlet ports being equal to the number of outlets.

Surrounding the head portion of the distributor member 28 is an annular cam ring 41 on the internal peripheral surface of which are formed pairs of diametrically disposed cam lobes. In the particular example three pairs of lobes are provided since the apparatus is intended to supply fuel to a six cylinder engine. Moreover, the cam ring 41 is angularly movable about the axis of rotation of the distributor member by means of a fluid pressure operable device generally indicated at 42 and connected to the cam ring by way of a radially disposed peg 43. The device 42 conveniently includes a resiliently loaded piston housed within a cylinder to one end of which liquid under pressure can be supplied to act on the piston to urge the piston against the action of its resilient loading.

Positioned at the outer ends of the plungers are a pair of followers each of which comprises a roller 44 carried in a shoe 45. The followers are retained axially relative to the distributor member by a pair of side plates 46, 47 which are secured to the side faces of the head portion of the distributor member. Conveniently as shown in FIG. 5, the side plates are of annular form and have a pair of outwardly extending tongues 48, which locate in the slots 16 formed in the enlarged portion of the drive shaft. In FIG. 5 the plate 46 is seen, the plates acting to transmit rotary motion to the distributor member from the drive shaft. The shoes 45 are also located within the aforesaid slots 16 and the rotary motion is transmitted to the shoes directly by the drive shaft. Moreover, the circumferential side faces of the shoes are provided with circumferentially extending projections 49 the radially outer surfaces of which are tapered to co-operate with the tapered surface formed on the internal surfaces of the enlarged portion of the drive shaft 14.

In use, when fuel is supplied to the bore 29, upon registration of a groove 32 with an inlet passage 37, the plungers 30 are moved outwardly by the fuel pressure and in so doing impart outward movement to the shoes 45 and the rollers 44. The outward movement is limited by the abutment of the tapered surfaces on the shoes and shaft and by moving the distributor member axially the extent of outward movement can be varied. Thus the amount of fuel being supplied to the bore 29 can be controlled and this in turn determines the amount of fuel delivered through an outlet when the plungers 30 are moved inwardly by a pair of cam lobes.

The axial position of the distributor member can be varied mechanically or hydraulically. In the arrangement described the variation is achieved by varying the pressure within a chamber 50 defined by the end portion of the bore 26 in the body portion 12, the end of the bore 26 is closed by a closure member. Moreover, the distributor member is biassed by means of a coiled compression spring 53 which is housed within the blind bore 18 formed in the drive shaft 14. The spring 53 acts between the drive shaft and the distributor member and urges the distributor member against the action of the fuel under pressure in the chamber 50.

By varying the pressure in the chamber 50 the axial position of the distributor member can be varied and therefore the amount of fuel delivered each time the plungers move inwardly can be varied.

For a given axial setting of the distributor member and ignoring leakage, the amount of fuel delivered by the plungers will remain the same throughout the speed range of the associated engine and an indication of the axial setting of the distributor member, is provided by a position transducer 54 which is carried on the end closure for the bore 26 and may be adjustably mounted thereon for the purpose of calibration. Conveniently the transducer has a part which is carried by the distributor member.

Formed in the distributor member 28 and as shown in FIGS. 6 and 7, are six equiangular spaced recesses in the form of grooves 55 which extend to the chamber 50. A pair of ports 56, 57 are formed in the body part and which register with a pair of said grooves at the same time. The port 56 extends to a passage 58A which communicates with the outlet of the supply pump, and associated with the port 56 is an on/off valve 58 the valve member of which is operated by an electromagnetic actuator 59. When electric current is supplied to the actuator the valve is opened and when the valve is opened and the port 56 in register with a groove 55 fuel is supplied to the chamber 50. As fuel is supplied to the chamber the pressure therein will increase and the distributor member will move against the action of the spring 53 to reduce the quantity of fuel delivered to the engine.

The port 57 contains an adjustable orifice defined by an adjustable plug 60 and through which fuel can escape from the chamber. If therefore the valve 58 remains closed whilst the ports 56, 57 are in communication with grooves 55 the pressure in the chamber 50 will fall and the distributor member will move towards the right to increase the amount of fuel delivered to the engine.

The supply of electric current to the actuator 59 is controlled by a control circuit which is supplied with pulse signals obtained from a transducer 61 which scans the surface of a collar having markings 62 on its periphery. The pulses produced by the transducer are shown at 63 and the crossover of the pulse is arranged to coincide with opening of the ports to the grooves 55. The period for which the ports are open is shown at 64 and in the example the valve 58 is opened after the ports have opened to the grooves. The later the valve 58 is opened the less fuel will flow into the chamber and vice versa. The pressure in the chamber 50 can therefore be controlled by varying the time the valve 58 is opened whilst the ports 56 and 57 are open to the grooves.

Alternatively the valve 58 can be opened before the ports open to the grooves and closed before the ports close to the grooves. The plug 60 can be omitted if the port 57 itself offers sufficient restriction to the flow of fuel. Moreover the roles of the ports can be reversed with fuel flowing into the chamber through the restricted port. In order to restrict the flow of fuel, the port 57 can be of smaller diameter than the port 56.

The ports 56, 57 can be positioned so that the chamber 50 is locked off during the times when the distributor member is subjected to axial forces as for example during inward movement of the plungers and also at the end of the filling stroke when the shoes engage the stop plates. In this manner the setting of the distributor member is more closely controlled as compared with the case where the on/off valve is replaced by a simple restrictor in direct communication with the chamber and with a permanent leakage from the chamber.

A similar arrangement can be utilised for controlling the pressure applied to the piston of the device 42.

In the case where the chamber is constituted by the portion of the bore disposed between the plungers 30, the distributor member would not be movable axially and whilst stop plates would still be supplied to limit the maximum outward movement of the plungers they would be of the type which are set upon calibration of the pump. The chamber in this case is only supplied with one flow passage and the on/off valve is provided in the flow passage to determine the amount of fuel supplied to the chamber whilst a groove 32 is in register with a port 37. The on/off valve controls the fuel flow to the port or ports 37 and may be of a similar construction to that shown in FIG. 6.

One example of a circuit for controlling the operation of the valve 58 in the example described in FIGS. 1-7, is seen in FIG. 8 and with reference to this figure, the outputs of the transducers 54, 61 are applied to shaping circuits 65, 66 respectively which may for example be zero crossing detectors. The pulse output of the circuit 65 is supplied to a gate circuit 67 to close the gate and the pulse output of the circuit 66 is applied to the gate 67 to open the gate. The gate circuit 67 has a connection to a clock pulse source 68 and the output of the gate is supplied to a counter 69. The count value in the counter 69 represents the time interval between the pulses at the outputs of the circuits 65 and 66 and since this time interval depends upon the axial position of the distributor member the count value in the counter is representative of the axial position of the distributor member and hence the amount of fuel which is being supplied to the associated engine.

A further gate circuit 70 is provided which has an input for clock pulses and an output connected to a counter 71. The gate is opened and closed by alternate pulses at the output of the circuit 66, the count value in the counter 71 is therefore representative of the speed of rotation of the distributor member, the count value decreasing as the speed of rotation of the distributor member increases, this also being true of the count value in the counter 69.

The count values in the counters 69 and 71 are supplied to a central processing unit 72 which also receives the clock pulses and has an input connected to a demand transducer 73 and a further input connected to receive the pulse signal provided by the shaping circuit 66. Moreover, associated with the processing unit 72 is a store 74 in which is stored information regarding for example the maximum amount of fuel which can be supplied to the associated engine for a given speed. The central processing unit has two outputs which control a flip-flop circuit 75 and this in time controls a power stage 76 which supplies current to the actuator 59.

The central processing unit on the basis of the signals supplied to strive to ensure that the demand placed upon the associated engine by the operator is satisfied whilst at the same time ensuring that no more fuel is supplied to the engine than is allowed for the particular engine speed. The signals at the outputs of the unit 72 are applied in strict timed relationship to the flip-flop circuit 75 to ensure that the actuator is turned on at the correct point in the cycle and is then turned off after in the example described a groove 55 has moved out of register with the port 56. The pulse signals provided by the transducers 61 enable the unit 72 to determine when the ports 56, 57 are open to grooves 55.

I claim:

1. A fuel pumping apparatus comprising a body part, a rotary distributor member located in the body part and adapted to be driven, in use, in timed relationship with the associated engine, a pumping plunger mounted in a transverse bore in the distributor member, a cam ring surrounding the distributor member and having angularly spaced cam lobes for imparting inward movement to the pumping plunger as the distributor member rotates, fluid pressure operable means for adjusting the setting of said cam ring whereby the timing of delivery of fuel can be varied, passage means for conveying fuel to and from the injection pump, a chamber defined at one end of the distributor member to which liquid is admitted to effect axial movement of the distributor member to vary an operating characteristic of the apparatus, means for varying the amount of liquid supplied to said chamber, said means comprising a flow passage for conveying liquid to said chamber, a valve in said flow passage comprising cooperating recesses and a port formed on the distributor member and body part, said body part being provided with a further port for registration in turn with said recesses, said further port being connected to a drain, flow restricting means for controlling flow through said further port whereby liquid can escape from said chamber at a restricted rate, said ports being brought into registration with a pair of said recesses respectively at the same time, said valve being operable to open and close said flow passage, said valve being operated upon rotation of the distributor member, means for determining when said valve is open, and an on/off valve located in said flow passage and operable while the valve is open to permit flow of liquid through the flow passage.

2. An apparatus according to claim 1 including a transducer mounted in the body part and responsive to the passage of markings on a part carried by the distributor member.

* * * * *